US008129643B2

(12) United States Patent
Anzai et al.

(10) Patent No.: US 8,129,643 B2
(45) Date of Patent: Mar. 6, 2012

(54) PUSHBUTTON TYPE SWITCH DEVICE

(75) Inventors: Ayumu Anzai, Miyagi-Ken (JP); Takashi Sato, Miyagi-Ken (JP)

(73) Assignee: Alps Electric Co., Ltd., Tokyo (JP)

( * ) Notice: Subject to any disclaimer, the term of this patent is extended or adjusted under 35 U.S.C. 154(b) by 362 days.

(21) Appl. No.: 12/534,528

(22) Filed: Aug. 3, 2009

(65) Prior Publication Data

US 2010/0032277 A1 Feb. 11, 2010

(30) Foreign Application Priority Data

Aug. 7, 2008 (JP) ..... 2008-204483

(51) Int. Cl.
*H01H 5/18* (2006.01)

(52) U.S. Cl. ..... 200/406; 200/516

(58) Field of Classification Search ..... 200/406, 200/516, 521

See application file for complete search history.

(56) References Cited

U.S. PATENT DOCUMENTS

| | | | | |
|---|---|---|---|---|
| 7,151,236 | B2 * | 12/2006 | Ducruet et al. | 200/406 |
| 2003/0042121 | A1 | 3/2003 | Hirahata et al. | |
| 2004/0074751 | A1 * | 4/2004 | Watanabe | 200/310 |

* cited by examiner

*Primary Examiner* — Vanessa Girardi
(74) *Attorney, Agent, or Firm* — Brinks Hofer Gilson & Lione

(57) ABSTRACT

Provided is a push-type switch device including: a switch element in which a dome-shaped reversing spring is accommodated in a switch casing; a holder which is mounted to the outside portion of the switch casing so as to define a position relative to the switch casing and has a perforation hole formed at a position adjacent to a center portion of the reversing spring so as to face the center portion; and a driving protrusion which is inserted through the perforation hole so as to reciprocate and is driven to push the reversing spring, wherein when the holder mounted on an upper portion of the switch casing is attached to a predetermined position of the interconnection substrate, the switch casing is held in the interconnection substrate.

7 Claims, 4 Drawing Sheets

PUSHBUTTON TYPE SWITCH DEVICE

The present invention claims the benefit of Japanese Patent Application JP 2008-204483 filed in the Japanese Patent Office on Aug. 7, 2008, the entire contents of which is incorporated herein by reference.

BACKGROUND

1. Technical Field

The present invention relates to a push-type switch device such as a push switch, and more particularly, to a push-type switch device configured to output an on signal when a driving protrusion pushed by a user reverses a reversing spring of a switch element.

2. Related Art

In a push-type switch device, a dome-shaped reversing spring formed by a conductive metal plate is used as a movable contact point of a switch element, and the reversing spring faces a fixed contact point of the switch element so as to move close to or away from the fixed contact point. In addition, a driving protrusion as an actuator is disposed above the center portion of the reversing spring, and the driving protrusion is adapted to push down the center portion of the reversing spring during a push operation of the switch device. When the center portion of the reversing spring is pushed down by a predetermined amount, the reversing spring is elastically deformed in a buckling manner to be reversed while generating a click feeling, and contacts with the fixed contact point provided below the reversing spring. That is, when the switch device is pushed, the reversing spring pushed by the driving protrusion to be reversed contacts with the fixed contact point provided below the reversing spring, so that an on signal is output and a user's finger feels a switching operation from an off state to an on state by means of a click feeling generated upon reversing the reversing spring.

This kind of push-type switch device is used while being mounted on an interconnection substrate. However, since the switch element having the reversing spring and a member for guiding the up-down movement (reciprocation movement) of the driving protrusion are individually attached to the interconnection substrate, a relative position between the reversing spring and the driving protrusion may easily change. For this reason, upon pushing the switch device, the driving protrusion may easily push a portion deviated from the center portion of the reversing spring. In this case, a problem arises in that the reversing spring cannot generate a clear click feeling or the reversing spring cannot be operated in a normal state due to a plastic deformation thereof.

For this reason, a switch device which allows a driving protrusion to reliably push a center portion of a reversing spring during a push operation of the switch device was proposed in US Patent Publication No. 2003-0042121 (corresponding to JP-A-2003-77364), where the switch device has a configuration in which a lower end portion of a driving protrusion is adhered to a center portion of a reversing spring in advance to be fixed thereto so as to simultaneously move up and down all the time without the worry of the positional deviation therebetween.

However, in the above-described known example, since the push-type switch device has a configuration in which the driving protrusion is adhered to the reversing spring to be fixed thereto, a complicated assembling operation is required to adhere the driving protrusion to the reversing spring to be fixed thereto while performing an accurate positioning operation therebetween. Further, a problem arises in that an adhesive has a negative impact on a reversing characteristic of the reversing spring and high reliability of the switch device cannot be maintained if a crack is generated in the adhesive caused by the repeated push operation. In addition, when the driving protrusion is adhered to the reversing spring to be fixed thereto, the driving protrusion cannot be rotated. Accordingly, in order to obtain a multi-functional switch device which can be both pushed and rotated, a plurality of manipulation members needs to be disposed so as not to interfere with each other. In this case, a problem arises in that the structure of the switch device becomes complicated and the cost thereof inevitably increases.

SUMMARY

An advantage of some aspects of the invention is to provide a push-type switch device in which a driving protrusion reliably pushes a center portion of a reversing spring during a push operation of the switch device, thereby obtaining the highly reliable push-type switch device which is easily assembled and is easily allowed to have multi-functions.

According to an aspect of the invention, there is provided a push-type switch device including: a switch element in which a dome-shaped reversing spring is accommodated in a switch casing; a holder which is mounted to the outside portion of the switch casing so as to define a position relative to the switch casing and has a perforation hole formed at a position adjacent to a center portion of the reversing spring so as to face the center portion; and a driving protrusion which is inserted through the perforation hole so as to reciprocate and is driven to push the reversing spring, wherein when the holder mounted on an upper portion of the switch casing is attached to a predetermined position of a interconnection substrate, the switch casing is held in the interconnection substrate.

In the push-type switch device with such a configuration, the relative position between the holder and the switch casing is defined, and the holder is provided with the perforation hole which faces the center portion of the reversing spring so as to be adjacent thereto. Since the position of the front end portion of the driving protrusion with respect to the reversing spring is regulated with high precision by the perforation hole, it is not necessary to worry about the positional deviation between the driving protrusion and the center portion of the reversing spring during the push operation of the switch device even when the positional precision of the holder or the driving protrusion with respect to the interconnection substrate is not particularly increased. Accordingly, it is possible to always generate a clear click feeling during the push operation of the switch device and thus to keep high reliability of the switch device. In addition, it is possible to simply attach the holder mounted to the outside portion of the switch casing to a predetermined position of the interconnection substrate by means of an appropriate method such as a press-fitting method or a snap-connection method. Further, since the switch casing is positioned on the interconnection substrate to be held therein by the holder, it is possible to easily solder the terminal portion of the switch element to an interconnection circuit. Accordingly, it is not necessary to worry about the deterioration of the assembling operation of the switch device even when the holder is further provided. In addition, since the driving protrusion facing the reversing spring can be rotated, it is possible to easily obtain a multi-functional switch device which can be both pushed and rotated.

DESCRIPTION OF EXEMPLARY EMBODIMENTS

Figure 1:
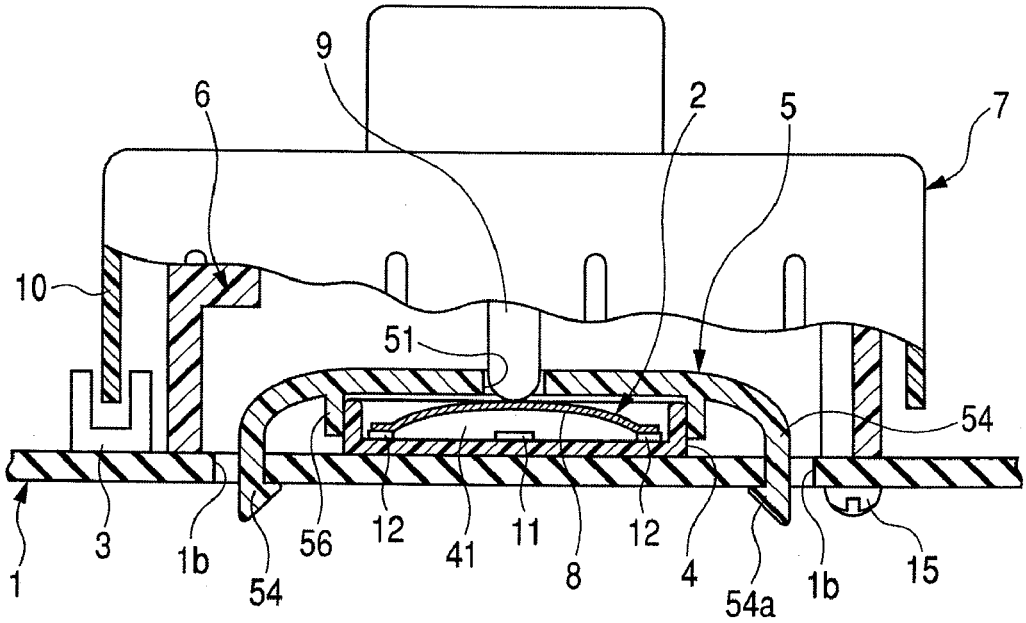
FIG. 1 is a cross-sectional view showing a switch device according to an embodiment of the invention.
Figure 2:
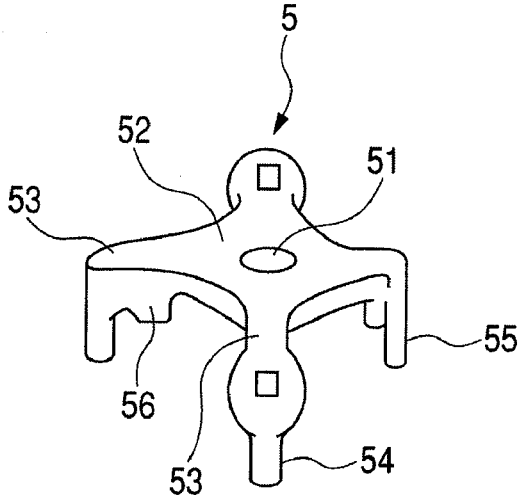
FIG. 2 is a perspective view showing a holder used in the switch device.
Figure 3:
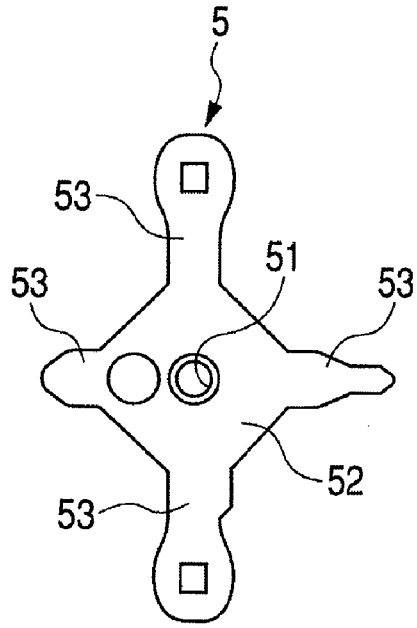
FIG. 3 is a top view showing the holder.
Figure 4:
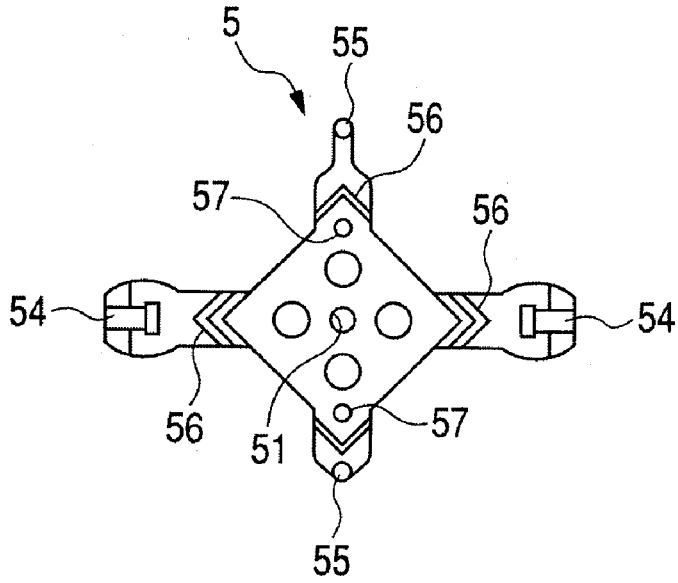
FIG. 4 is a bottom view showing the holder.
Figure 5:
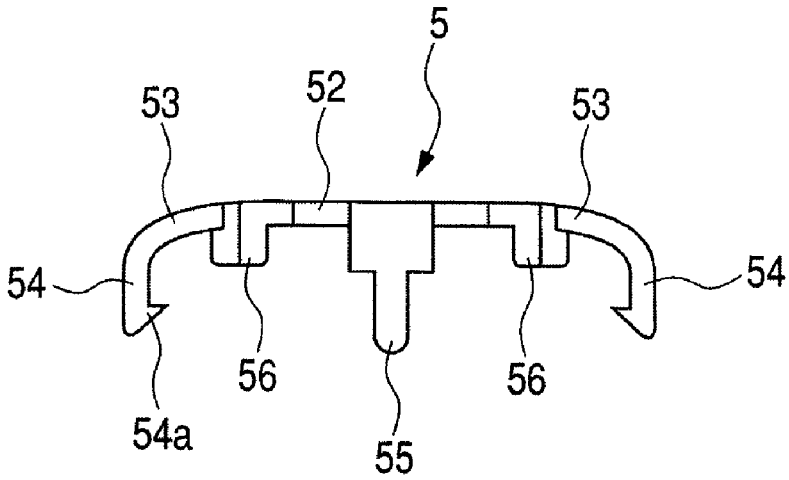
FIG. 5 is a side view showing the holder in a longitudinal direction.
Figure 6:
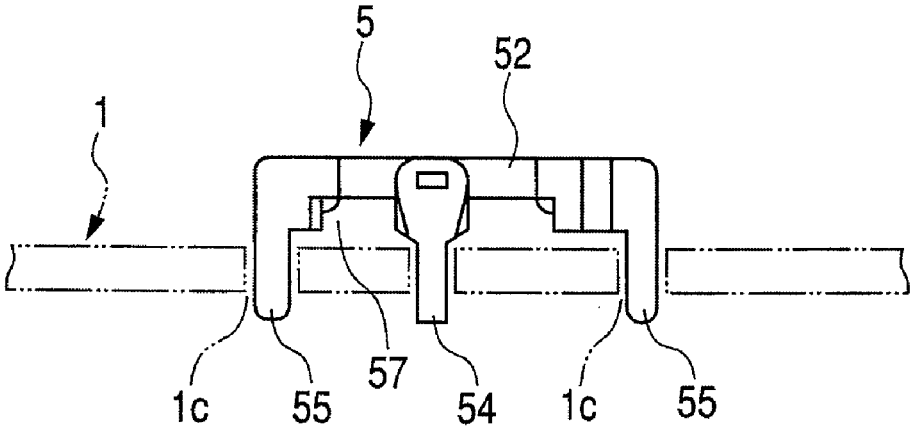
FIG. 6 is a side view showing the holder in a width direction.
Figure 7:
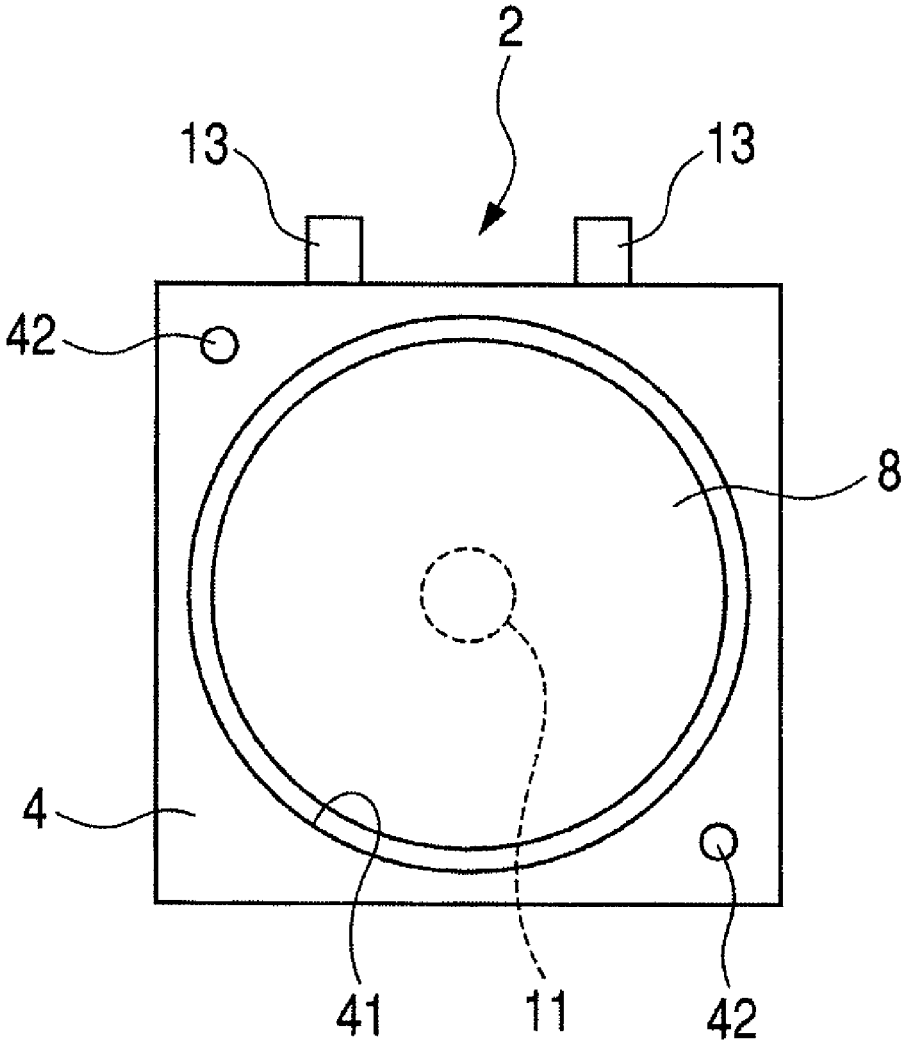
FIG. 7 is a top view showing a switch element used in the switch device.

An exemplary embodiment of the invention will be described with reference to the accompanying drawings. FIG. 1 is a cross-sectional view showing a switch device according to an embodiment of the invention. FIG. 2 is a perspective view showing a holder used in the switch device. FIG. 3 is a top view showing the holder. FIG. 4 is a bottom view showing the holder. FIG. 5 is a side view showing the holder in a longitudinal direction. FIG. 6 is a side view showing the holder in a width direction. FIG. 7 is a top view showing a switch element used in the switch device.

The switch device shown in FIG. 1 mainly includes a switch element 2 which is mounted on an interconnection substrate 1, a photo interrupter 3 which is mounted on the interconnection substrate 1, a holder 5 which is provided on the outside of a switch casing 4 of the switch element 2 and is attached to the interconnection substrate 1, a holding member 6 which is fixed to the interconnection substrate 1 and covers the switch element 2, and a manipulation member 7 which is held by the holding member 6 so as to be elevatable and rotatable. A dome-shaped reversing spring 8 is accommodated in the switch casing 4. The switch device can be operated as a push switch by means of a configuration in which a driving protrusion 9, provided at the center portion of the lower surface of the manipulation member 7, is disposed at a position right above the center portion of the reversing spring 8 and the driving protrusion 9 pushes down the reversing spring 8 so as to be reversed during the push operation of the switch device. In addition, a light shielding wall 10 provided in the outermost peripheral portion of the manipulation member 7 can be operated as a rotary encoder by means of a configuration in which the light shielding wall 10 passes through a gap between light emitting and receiving elements of the photo interrupter 3 during the rotation operation.

As shown in FIGS. 1 and 7, the switch element 2 includes the switch casing 4 which has an accommodation concave portion 41 formed at the upper surface thereof, a central fixed contact point 11 which is disposed in the inner bottom surface of the accommodation concave portion 41, a peripheral edge fixed contact point 12 which is disposed in the inner bottom surface of the accommodation concave portion 41, two terminals 13 which are drawn out from both fixed contact points 11 and 12 and protrude toward the side of the switch casing 4, the reversing spring 8 which is formed by a conductive metal plate accommodated in the accommodation concave portion 41, and a flexible sheet (not shown) which opens or closes the accommodation concave portion 41. The switch casing 4 is formed as a resinous molded product having an external shape of a square in a top view. Positioning holes 42 are respectively formed at two positions of corner portions in an external region of the circular accommodation concave portion 41. The outer peripheral portion of the reversing spring 8 is mounted on the peripheral edge fixed contact point 12 so as to be electrically connected to the peripheral edge fixed contact point 12 all the time, and the center portion of the reversing spring 8 faces the central fixed contact point 11 so as to be capable of moving close to or away from the central fixed contact point 11. The reversing spring 8 is a movable contact point of the switch element 2. When the center portion of the reversing spring 8 is pushed down by a predetermined amount, the reversing spring 8 is elastically deformed in a buckling manner so as to contact with the central fixed contact point 11 therebelow and to generate a click feeling during the reversing operation. Each terminal 13 is bent in an L-shape and is inserted through a through hole (not shown) of the interconnection substrate 1, where the front end portion of the terminal 13 is soldered to the lower surface of the interconnection substrate 1. In addition, the flexible sheet is provided so as to prevent alien substances such as dust from entering the accommodation concave portion 41.

The holder 5 is a resinous molded product, where four arm pieces 53 protrude in a substantially cross direction from a rectangular ceiling plate portion 52 having a perforation hole 51 formed at the center portion thereof. In addition, the front end portions of a pair of arm pieces 53 extending in the longitudinal direction are respectively provided with elastic leg portions 54, and the front end portions of a pair of arm pieces 53 extending in the width direction are respectively provided with positioning pins 55. A locking claw 54*a* is formed at the lower end portion of each elastic leg portion 54, and the elastic leg portion 54 is snap-connected to a notch portion 1*b* provided in the interconnection substrate 1. That is, as shown in FIG. 1, the interconnection substrate 1 is provided with the notch portions 1*b* which are respectively provided at two positions with the mounting region of the switch casing 4 interposed therebetween. When the locking claw 54*a* of the elastic leg portion 54 is locked to the inner wall portion of the notch portion 1*b* by means of the elasticity thereof, the elastic leg portion 54 is attached to the interconnection substrate 1. In addition, the interconnection substrate 1 is provided with positioning holes 1*c* (see FIG. 6) which are provided at two positions so as to be away from each other with the mounting region of the switch casing 4 interposed therebetween, and each positioning pin 55 is fitted into each positioning hole 1*c*. Accordingly, when the elastic leg portion 54 is snap-connected to the notch portion 1*b* while fitting the positioning pin 55 to the positioning hole 1*c*, the holder 5 can be simply attached to a predetermined position of the interconnection substrate 1.

In addition, as shown in FIG. 4, the lower surface of each arm piece 53 of the holder 5 is provided with a regulation wall portion 56 formed in an L-shape in a top view. Short positioning bosses 57 are respectively provided on the inside of two regulation wall portions 56 which are located in the vicinity of the positioning pins 55 and face each other. Since four regulation wall portions 56 of the holder 5 are fitted to the outside of four corners of the switch casing 4, the regulation wall portions 56 regulate the outside positions of the corner portions of the switch casing 4. In addition, the positioning bosses 57 are respectively fitted into the positioning holes 42 (see FIG. 7) exposed to the corner portions of the upper surface of the switch casing 4. For this reason, the relative position between the holder 5 and the switch casing 4 is regulated with high precision. As shown in FIG. 1, when the holder 5 is mounted to the outside portion of the switch casing 4, the perforation hole 51 is located at a position right above the center portion of the reversing spring 8 and faces the center portion thereof so as to be adjacent thereto. Since the lower end portion (front end portion) of the driving protrusion 9 is inserted through the perforation hole 51, the lower end portion of the driving protrusion 9 moves up and down (reciprocates) at a position right above the center portion of the reversing spring 8 due to the position regulation of the perforation hole 51. In addition, as described above, since the holder 5 is attached to a predetermined position of the interconnection substrate 1, the switch casing 4 is maintained to be positioned to the interconnection substrate 1, where the relative position between the holder 5 and the switch casing 4 is maintained with high precision. In addition, when the holder 5 mounted to the outside portion of the switch casing 4 is attached to the interconnection substrate 1, the switch casing 4 is interposed between the positioning boss 57 and the interconnection substrate 1. Accordingly, the switch casing 4 disposed on the interconnection substrate 1 is positioned in a height direction as well as in a horizontal plane by the holder 5. Incidentally, since the terminal 13 of the switch element 2 is provided at one corner of the switch casing 4, the posture of the switch casing 4 easily changes upon pushing the driving protrusion 9. However, in the embodiment, since the switch casing 4 is positioned in the height direction and the horizontal plane as described above, the posture of the switch casing 4 does not change.

The holding member 6 is screw-fixed to the interconnection substrate 1 by means of a plurality of fixed screws 15. The attachment position of the holding member 6 with respect to the interconnection substrate 1 is regulated by a positioning pin (not shown). As shown in FIG. 1, the reversing spring 8 and the holding member 6 covering the switch element 2 are substantially concentrically provided. Since the manipulation member 7 is assembled to the holding member 6 in a concentric shape so as to be elevatably and rotatably held therein, the driving protrusion 9 of the manipulation member 7 is located at a position substantially right above the center portion of the reversing spring 8. However, the holding member 6 and the holder 5 are individually attached to the interconnection substrate 1, and a slight error inevitably occurs in the attachment positions thereof. Accordingly, the driving protrusion 9 may be slightly deviated from the position right above the center portion of the reversing spring 8. However, in this embodiment, when the holder 5 is mounted to the outside portion of the switch casing 4, the perforation hole 51 is automatically located at the position right above the center portion of the reversing spring 8. Then, since the lower end portion of the driving protrusion 9 is inserted through the perforation hole 51 so as to be elevatable, even when the upper end portion (base end portion) of the driving protrusion 9 is slightly deviated from the reversing spring 8 in a radial direction, the lower end portion of the driving protrusion 9 does not push a portion deviated from the center portion of the reversing spring 8 during the push operation of the switch device.

In the switch device with such a configuration, when a user pushes the manipulation member 7, the driving protrusion 9 moves down. Accordingly, the lower end portion of the driving protrusion 9 pushes down the center portion of the reversing spring 8 so as to be reversed. As a result, since the reversing spring 8 as a movable contact point contacts with the central fixed contact point 11, the central fixed contact point 11 and the peripheral edge fixed contact point 12 are electrically connected to each other via the reversing spring 8, so that an on signal is output from the terminal 13 and the user's finger feels a switching operation from an off state to an on state by means of a click feeling generated upon reversing the reversing spring 8.

In addition, when the user rotates the manipulation member 7, the light shielding wall 10 passes through the light emitting and receiving elements of the photo interrupter 3, thereby detecting a rotation angle or a rotation direction of the manipulation member 7.

As described above, in the switch device according to the embodiment, the holder 5 mounted to the outside portion of the switch casing 4 is attached to a predetermined position of the interconnection substrate 1, and the lower end portion of the driving protrusion 9 is elevatably inserted through the perforation hole 51 which faces the center portion of the reversing spring 8 so as to be adjacent thereto. For this reason, the position of the lower end portion of the driving protrusion 9 can be regulated with high precision by the perforation hole 51 during the push operation of the switch device. Accordingly, it is possible to reliably push the center portion of the reversing spring 8 using the driving protrusion 9 during the push operation of the switch device without particularly increasing the positional precision of the driving protrusion 9 or the holder 5 with respect to the interconnection substrate 1. That is, since the driving protrusion 9 does not push a portion deviated from the center portion of the reversing spring 8 during the push operation of the switch device even when a slight error exists in the attachment position of the holding member 6 or the holder 5 with respect to the interconnection substrate 1, it is possible to always generate a clear click feeling and thus to easily keep the high reliability thereof. In addition, since the holder 5 mounted to the outside portion of the switch casing 4 can be simply attached to the interconnection substrate 1 by a snap-connection operation or the like, even when the holder 5 is further provided, the assembling operation thereof does not deteriorate. On the contrary, since the switch casing 4 can be positioned on the interconnection substrate 1 to be held therein via the holder 5, it is possible to easily carry out the soldering operation of the terminal 13. In addition, since the manipulation member 7 provided with the driving protrusion 9 can be both pushed and rotated, it is possible to obtain the multi-functional switch device at a low cost without increasing the number of manipulation members.

Further in the embodiment, since the holder 5 is provided with the regulation wall portion 56 fitted to the outside of the switch casing 4 and the positioning boss 57 fitted into the positioning hole 42 of the switch casing 4, it is possible to simply attach the holder 5 to the outside of the switch casing 4 and to regulate the relative position between the switch casing 4 and the holder 5 with high precision. However, the position, shape, number, or the like of the regulation wall portion 56 or the positioning boss 57 may be appropriately selected. In the same manner, the position, shape, number, or the like of the elastic leg portion 54 or the positioning pin 55 used to attach the holder 5 to a predetermined position of the interconnection substrate 1 may be appropriately selected.

Furthermore, in the embodiment, the switch device adapted to be both pushed and rotated is described, but the invention may be, of course, applied to a switch device only adapted to be pushed.

It should be understood by those skilled in the art that various modifications, combinations, sub-combinations and alterations may occur depending on design requirements and other factors insofar as they are within the scope of the appended claims of the equivalents thereof.

What is claimed is:

1. A pushbutton type switch device comprising:

a switch element in which a dome-shaped reversing spring is accommodated in a switch casing;

a holder, which is mounted to an outside portion of the switch casing so as to define a position relative to the switch casing and has a perforation hole formed at a position adjacent to a center portion of the reversing spring so as to face the center portion; and a driving protrusion, which is inserted through the perforation hole so as to reciprocate and is driven to push the reversing spring, wherein the holder includes a rectangular ceiling plate portion and arm pieces that protrude in a substantially cross direction from the rectangular ceiling plate portion, wherein the arm pieces include a pair of holding arm pieces and a pair of positioning arm pieces, front end portions of the pair of holding arm pieces being respectively provided with elastic leg portions, front end portions of the pair of positioning arm pieces being respectively provided with positioning pins, wherein the positioning pins are inserted into positioning holes formed at a predetermined position of an interconnection substrate mounted on an upper portion of the switch casing and the elastic leg portions are snap-connected to notch portions of the interconnect substrate so as to mount the holder to the interconnect substrate, the switch casing is whereby held on the interconnection substrate.

2. The push-type pushbutton type switch device according to claim 1, wherein the notch portions are respectively provided at positions which are separated from each other with a region, where the switch casing is mounted on the interconnection substrate, interposed therebetween.

3. The pushbutton type switch device according to claim 1, wherein the reversing spring is disposed in an accommodation concave portion formed in an upper surface of the switch casing, and the driving protrusion is disposed above the reversing spring.

4. The pushbutton type switch device according to claim 1, wherein the pair of holding arm pieces is in opposite arrangement in a direction of one axis of the substantially cross direction, whereas the pair of positioning arm pieces is in opposite arrangement in a direction of the other axis of the substantially cross direction.

5. The pushbutton type switch device according to claim 1, wherein a length of the pair of positioning arm pieces from the rectangular ceiling plate portion is less than that of the pair of holding arm pieces.

6. The pushbutton type switch device according to claim 1, wherein the holder includes a positioning boss, which is fitted into a positioning hole of the switch casing.

7. The pushbutton type switch device according to claim 6, wherein the holder includes a regulation wall portion, which is fitted to the outside of the switch casing.

* * * * *

UNITED STATES PATENT AND TRADEMARK OFFICE

CERTIFICATE OF CORRECTION

PATENT NO. : 8,129,643 B2
APPLICATION NO. : 12/534528
DATED : March 6, 2012
INVENTOR(S) : Ayumu Anzai et al.

It is certified that error appears in the above-identified patent and that said Letters Patent is hereby corrected as shown below:

In the Claims

In column 7, claim 2, line 22, before "pushbutton type switch device" delete "push-type".

Signed and Sealed this
Twenty-sixth Day of June, 2012

David J. Kappos

David J. Kappos
*Director of the United States Patent and Trademark Office*